US010304603B2

(12) United States Patent
Doris et al.

(10) Patent No.: US 10,304,603 B2
(45) Date of Patent: May 28, 2019

(54) STRESS CONTROL IN MAGNETIC INDUCTOR STACKS

(71) Applicant: International Business Machines Corporation, Armonk, NY (US)

(72) Inventors: Bruce B. Doris, Hartsdale, NY (US); Hariklia Deligianni, Alpine, NJ (US); Eugene J. O'Sullivan, Nyack, NY (US); Naigang Wang, Ossining, NY (US)

(73) Assignee: INTERNATIONAL BUSINESS MACHINES CORPORATION, Armonnk, NY (US)

( * ) Notice: Subject to any disclaimer, the term of this patent is extended or adjusted under 35 U.S.C. 154(b) by 0 days.

(21) Appl. No.: 15/196,640

(22) Filed: Jun. 29, 2016

(65) Prior Publication Data

US 2018/0005740 A1 Jan. 4, 2018

(51) Int. Cl.

| | |
|---|---|
| ***H01F 3/02*** | (2006.01) |
| ***H01F 3/10*** | (2006.01) |
| ***H01F 27/25*** | (2006.01) |

(52) U.S. Cl.

CPC ..... *H01F 3/02* (2013.01); *H01F 3/10* (2013.01); *H01F 27/25* (2013.01)

(58) Field of Classification Search

CPC ..... H01F 3/02

See application file for complete search history.

(56) References Cited

U.S. PATENT DOCUMENTS 4,640,871 A * 2/1987 Hayashi ..... H01F 1/18 360/125.5
5,032,945 A * 7/1991 Argyle ..... B82Y 25/00 360/125.39

(Continued)

FOREIGN PATENT DOCUMENTS

CN 104485325 A 4/2015
JP 0636934 A 6/1994

(Continued)

OTHER PUBLICATIONS

Notification of Transmittal of the International Search Report and the Written Opinion of the International Searching Authority, or the Delcaration, issued in PCT/IB2017/052694 dated Sep. 1, 2017; 12 pages.

(Continued)

*Primary Examiner* — Elvin G Enad
*Assistant Examiner* — Malcolm Barnes
(74) *Attorney, Agent, or Firm* — Cantor Colburn LLP; Vazken Alexanian

(57) ABSTRACT

A magnetic laminating structure and process for preventing substrate bowing include multiple film stack segments that include a first magnetic layer, at least one additional magnetic layer, and a dielectric spacer disposed between the first and at least one additional magnetic layers. A dielectric isolation layer is intermediate magnetic layers and on the sidewalls thereof. The magnetic layers are characterized by defined tensile strength and the multiple segments function to relive the stress as the magnetic laminating structure is formed, wherein the cumulative thickness of the magnetic layers is greater than 1 micron. Also described are methods for forming the magnetic laminating structure.

11 Claims, 5 Drawing Sheets

(56) References Cited

U.S. PATENT DOCUMENTS 6,346,336 B1 * 2/2002 Nago ..... B82Y 25/00 204/192.2
7,107,666 B2 * 9/2006 Hiatt ..... H01F 17/0006 29/602.1
7,463,131 B1 12/2008 Hwang et al.
7,719,084 B2 5/2010 Gardner et al.
7,723,827 B2 * 5/2010 Katoh ..... B82Y 10/00 257/659
7,867,787 B2 1/2011 Gardner et al.
8,102,236 B1 1/2012 Fontana, Jr. et al.
8,717,136 B2 5/2014 Fontana, Jr. et al.
8,754,500 B2 6/2014 Webb
9,047,890 B1 * 6/2015 Herget ..... G11B 5/39
9,064,628 B2 6/2015 Fontana, Jr. et al.
9,697,948 B2 7/2017 Osada et al.
9,882,121 B2 * 1/2018 Kuo ..... H01L 43/02
2002/0130386 A1 * 9/2002 Acosta ..... H01F 17/0006 257/531
2003/0029520 A1 2/2003 Ingvarsson et al.
2003/0209295 A1 11/2003 Cooper et al.
2005/0093437 A1 * 5/2005 Ouyang ..... H01L 51/5281 313/506
2007/0297101 A1 * 12/2007 Inomata ..... B82Y 10/00 360/324.11
2008/0003699 A1 * 1/2008 Gardner ..... H01F 41/046 438/3
2009/0219754 A1 * 9/2009 Fukumoto ..... B82Y 25/00 365/158
2010/0014178 A1 * 1/2010 Okami ..... G02B 5/205 359/888
2010/0087066 A1 * 4/2010 O'Sullivan ..... B82Y 25/00 438/754
2011/0001202 A1 * 1/2011 Gardner ..... H01L 23/5227 257/421
2011/0175193 A1 * 7/2011 Nakagawa ..... H01L 21/76801 257/531
2012/0236528 A1 * 9/2012 Le ..... H05K 9/0088 361/818
2012/0299137 A1 * 11/2012 Worledge ..... B82Y 25/00 257/421
2013/0024887 A1 1/2013 Vasudevan et al.
2013/0106552 A1 * 5/2013 Fontana, Jr. ..... H01F 17/0013 336/200
2013/0224887 A1 * 8/2013 Lee ..... C23C 14/0617 438/3
2013/0314192 A1 * 11/2013 Fontana, Jr. ..... H01F 5/00 336/200
2013/0316503 A1 * 11/2013 Doris ..... H01L 21/823835 438/229
2014/0021426 A1 * 1/2014 Lee ..... H01L 43/02 257/1
2014/0061853 A1 * 3/2014 Webb ..... H01L 23/5227 257/531
2014/0190003 A1 7/2014 Fonatana, Jr. et al.
2014/0216939 A1 * 8/2014 Fontana, Jr. ..... C25D 7/123 205/50
2014/0239443 A1 * 8/2014 Gallagher ..... C23C 18/1834 257/531
2014/0339653 A1 11/2014 Chang et al.
2015/0097267 A1 4/2015 Tseng et al.
2015/0171157 A1 * 6/2015 Sturcken ..... H01L 23/5223 257/531
2017/0256708 A1 * 9/2017 Krounbi ..... H01L 43/12

FOREIGN PATENT DOCUMENTS

JP 2006178395 A 7/2006
JP 2010080774 A 4/2010
JP 5096278 B2 12/2012

OTHER PUBLICATIONS

Bruce B. Doris, et al., Pending U.S. Appl. No. 15/197,866 entitled, "Stress Control in Magnetic Inductor Stacks," filed Jun. 30, 2016. Listof IBM Patents or Patent Applications Treated as Related; (Appendix P), Date Filed Jan. 2, 2018; 2 pages.

* cited by examiner

STRESS CONTROL IN MAGNETIC INDUCTOR STACKS

BACKGROUND

The present invention relates to on-chip magnetic devices, and more specifically, to on-chip magnetic structures and methods for relieving stress and preventing wafer bowing.

On-chip magnetic inductors/transformers are important passive elements with applications in the fields such as on-chip power converters and radio frequency (RF) integrated circuits. In order to achieve high energy density, magnetic core materials with thickness ranging several 100 nm to a few microns are often implemented. For example, in order to achieve the high energy storage required for power management, on-chip inductors typically require relatively thick magnetic yoke materials (several microns or more). There are two basic configurations, closed yoke and solenoid structure inductors. The closed yoke has copper wire with magnetic material wrapped around it and the solenoid inductor has magnetic material with copper wire wrapped around it. Both inductor types benefit by having very thick magnetic materials. One issue with depositing thicker materials is tensile stress. Magnetic materials have tensile stress when deposited, wherein the stress in the thickness required for these materials can cause wafers to bow. The wafer bow can cause issues with lithography alignment and wafer chucking on processing tools, among others. Tensile stress for magnetic materials can be about 50 to about 400 megapascals (MPa). However, since the total magnetic film thickness requirement is greater than 1 micrometer (μm) to in excess of 1000 μm, wafer bow can be considerably high.

SUMMARY

The present invention is directed to inductor structures and methods of forming the inductor structures. In one or more embodiments, the inductor structure includes a plurality of laminated film stacks separated by a space, each film stack comprising alternating layers of magnetic materials and insulating materials disposed on a processed wafer; and at least one dielectric isolation layer conformally deposited onto and within the film stacks having a thickness effective to electrically isolate the film stacks from one another, wherein each of the at least one dielectric isolation layers is intermediate to or on a portion of the alternating layers of magnetic materials and insulating materials in the film stacks, wherein the layers of magnetic materials have a cumulative thickness greater than 1 micron.

In one or more embodiments, a method of forming an inductor structure includes depositing a first grouping of alternating magnetic and insulating layers on a processed substrate, patterning the first grouping to provide a plurality of film stacks comprising the first grouping, wherein the film stacks are separated by a space; depositing a conformal layer of a dielectric isolation layer onto the patterned first grouping; depositing at least one additional grouping of alternating magnetic and insulating layers onto the dielectric isolation layer; and selectively removing the at least one additional grouping from the space; wherein the magnetic layers have a cumulative thickness greater than 1 micron.

In one or more embodiments, a method of forming an inductor structure includes forming multiple film stacks separated by a space, wherein the multiple film stacks comprise a first grouping of alternating magnetic and insulating layers on a processed substrate; forming at least one additional grouping on the multiple film stacks the additional grouping comprising alternating magnetic and insulating layers; and providing a dielectric isolation layer intermediate the first grouping and the at least one additional grouping, wherein the magnetic layers have a cumulative thickness greater than 1 micron.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Described herein are on chip magnetic inductor structures and methods for relieving stress as a function of the relatively thick magnetic layers utilized therein. The inductors can be configured as closed yoke or solenoid structure inductors. The cumulative thickness of the magnetic layers is in excess of 1 micron up to several microns. The magnetic inductor structures and methods generally include multiple patterning steps to provide stress balanced laminated magnetic stack structures separated by a space and methods for forming the laminated structure. The spacing provided by the patterning step reduces stress and prevents wafer bowing. A dielectric isolation layer is intermediate groupings of magnetic layers and functions to electrically isolate the magnetic stack structures from one another. Embodiments of a laminated magnetic material for inductors in integrated circuits and the method of manufacture thereof will be described.

Figure 1:
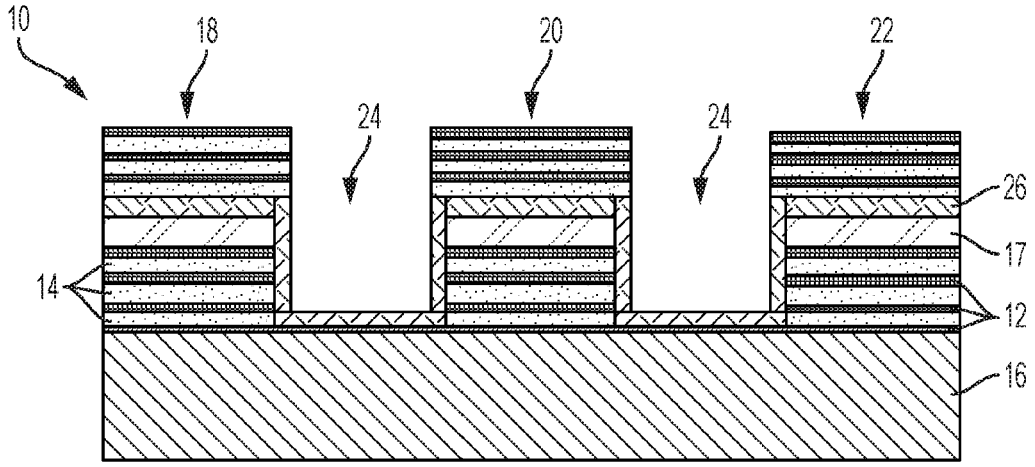
FIG. 1 illustrates a schematic cross sectional view of an inductor structure in accordance with the present invention.

Turning now to FIG. 1, there is depicted a cross section of an exemplary inductor structure in accordance with the present invention. The inductor structure 10 generally includes a plurality of alternating insulating layers 12 and magnetic layers 14 disposed on a processed wafer 16. The plurality of alternating insulating layers 12 and magnetic layers 14 represent a portion of the completed inductor structure. The alternating insulating layers 12 and magnetic layers 14 are lithographically patterned using a hard mask 17 to provide multiple film stacks, e.g., the three film stacks 18, 20, 22, separated by a space 24, which is effective to relieve the tensile stress provided by the magnetic materials and prevent wafer bow as the magnetic film stack is fully built to provide the magnetic layers with a cumulative thickness greater than 1 micron to in excess of 1000 microns. Conventional inductor stacks have many laminations of magnetic materials with dielectric material in between. The issue with this approach is that several microns of laminated stack thickness is needed to fabricate a high performance inductor. The overall thickness of a conventional laminated stack is limited by the stress in the magnetic material. By way of example, for a magnetic material with stress of approximately 400 MPa the wafer will exhibit about 150 um of bowing for a 1000 nm thick magnetic stack. This amount of bowing prohibits the use of state of the art lithography and other processing tools due to wafer chucking issues, that is, the wafer cannot sit flat on the process tool wafer holder. Advantageously, the present invention is directed to a multiple segmented stack. Specifically, a laminated magnetic stack is formed with conventional magnetic and dielectric materials up to 500 nm so that the bow is limited to 75 nm or less for a 200 nm wafer. Next the 500 nm stack is patterned. The patterning relaxes the global strain, the bowing is eliminated by the patterning and the wafer becomes flat. After this step another 500 nm of laminated stack is deposited and subsequently patterned. This process is iterated until the final total desired thickness of magnetic material is deposited, and patterned. A dielectric spacer of about 500 nm can be used to protect the sidewall of the magnetic materials from connecting to the subsequent layer magnetic materials. The space between film stacks is not intended to be limited and in one or more embodiments is about 300 to 500 Angstroms. The inductor structure further includes a conformal dielectric layer 26 on the grouping of alternating insulating and magnetic layers to protect the sidewalls as noted above. At least one additional grouping of alternating insulating layers 12 and magnetic layers 14 is then conformally deposited onto the dielectric isolation layer 26. The process of depositing a dielectric stack isolation layer followed by successive deposition of alternating insulating layers 12 and magnetic layers 14 can be repeated as desired to until the desired cumulative thickness of the magnetic layers, which is at least 1 micron and can be as thick as several microns. The number of magnetic layers within a specific grouping is not intended to be limited and will generally depend on the magnitude of tensile stress provided by a particular magnetic material.

A "processed wafer" is herein defined as a wafer that has undergone semiconductor front end of line processing (FEOL) middle of the line processing (MOL), and back end of the line processing (BEOL), wherein the various desired devices and circuits have been formed.

The typical FEOL processes include wafer preparation, isolation, well formation, gate patterning, spacer, extension and source/drain implantation, silicide formation, and dual stress liner formation. The MOL is mainly gate contact formation, which is an increasingly challenging part of the whole fabrication flow, particularly for lithography patterning. The state-of-the-art semiconductor chips, the so called 14 nm node of Complementary Metal-Oxide-Semiconductor (CMOS) chips, in mass production features a second generation three dimensional (3D) FinFET, a metal one pitch of about 55 nm and copper (Cu)/low-k (and air-gap) interconnects. In the BEOL, the Cu/low-k interconnects are fabricated predominantly with a dual damascene process using plasma-enhanced CVD (PECVD) deposited interlayer dielectric (ILDs), PVD Cu barrier and electrochemically plated Cu wire materials.

Each of the magnetic layers 14 in the laminate stack can have a thickness of about 50 to about 100 nanometers or more and typically has a tensile stress value within a range of about 50 to about 400 MPa. Tensile stress is a type of stress in which the two sections of material on either side of a stress plane tend to pull apart or elongate. In contrast, compressive stress is the reverse of tensile stress, wherein adjacent parts of the material tend to press against each other through a typical stress plane. The presence of the tensile stress, if unabated, leads to wafer bowing as the cumulative thickness of the magnetic layers exceeds 1 micron. Wafer bowing results in lithographic alignment issues, among other issues, which is needed to complete the device.

The magnetic layers 14 can be deposited through vacuum deposition technologies (i.e., sputtering) or electrodepositing through an aqueous solution. Vacuum methods have the ability to deposit a large variety of magnetic materials and to easily produce laminated structures. However, they usually have low deposition rates, poor conformal coverage, and the derived magnetic films are difficult to pattern. Electroplating has been a standard technique for the deposition of thick metal films due to its high deposition rate, conformal coverage and low cost.

The magnetic layers 14 are not intended to be limited to any specific material and can include CoFe, CoFeB, CoZrTi, CoZrTa, CoZr, CoZrNb, CoZrMo, CoTi, CoNb, CoHf, CoW, FeCoN, FeCoAlN, CoP, FeCoP, CoPW, CoBW, CoPBW, FeTaN, FeCoBSi, FeNi, CoFeHfO, CoFeSiO, CoZrO, CoFeAlO, combinations thereof, or the like. Inductor core structures from these materials have generally been shown to have low eddy losses, high magnetic permeability, and high saturation flux density.

The insulating layers 12 are not intended to be limited to any specific material and can include dielectric materials such as silicon dioxide ($SiO_2$), silicon nitride (SiN), silicon oxynitride ($SiO_xN_y$), or the like. The bulk resistivity and the eddy current loss of the magnetic structure can be controlled by the insulating layer. The thickness of the insulating layers 16 should be minimal and is generally at a thickness effective to electrically isolate the magnetic layer upon which it is disposed from other magnetic layers in the film stack. Generally, the insulating layer has a thickness of about 10 to about 100 nanometers.

The insulating layers 12 can be deposited using a deposition process, including, but not limited to, PVD, CVD, PECVD, or any combination thereof.

The stress presented by the cumulative thickness of the magnetic layers can be relieved by multiple patterning steps of the alternating insulating and magnetic layers to define the numerous film stacks. Once the different film stacks have been formed with a grouping of alternating insulating and magnetic layers, a dielectric isolation layer can be deposited to electrically isolate the film stacks from one another. In this manner, wafer bowing can be prevented.

The inductor structure as described can be integrated in a variety of devices. A non-limiting example of inductor integration is a transformer, which can include metal lines (conductors) formed parallel to each other by standard silicon processing techniques directed to forming metal features. The inductor structures can be formed about the parallel metal lines to form a closed magnetic circuit and to provide a large inductance and magnetic coupling among the metal lines. The inclusion of the magnetic material and the substantial or complete enclosure of the metal lines can increase the magnetic coupling between the metal lines and the inductor for a given size of the inductor. Inductors magnetic materials are also useful for RF and wireless circuits as well as power converters and EMI noise reduction.

Figure 2:
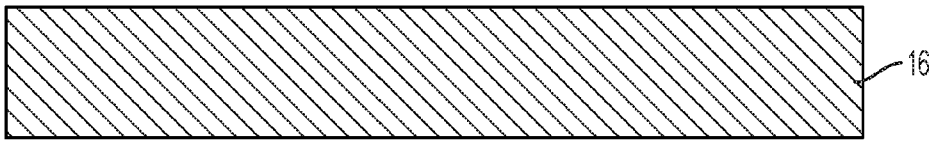
FIG. 2 depicts a schematic cross-sectional view of the inductor structure following FEOL, MOL, and BEOL processing of a substrate.

Referring now to FIGS. 2-11, the process of forming the on chip magnetic inductor structure having reduced stress is shown and generally begins with the processed wafer as shown in FIG. 2, which is after FEOL, MOL, and BEOL processing has been completed and typically has a planar uppermost surface.

Figure 3:
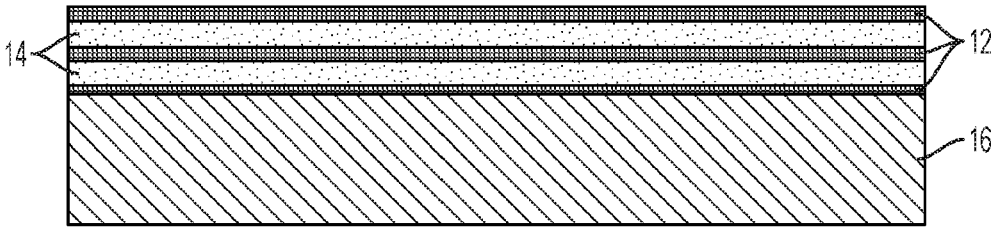
FIG. 3 depicts a schematic cross-sectional view of the inductor structure following deposition of a portion of the alternating insulating layers and magnetic layers onto the processed substrate.

In FIG. 3, a grouping of alternating insulating layers 12 and magnetic layers 14 is deposited onto the processed wafer 16. The number of alternating insulating layers 12 and magnetic layers 14 within the grouping is a fraction of the number of alternating insulating layers 12 and magnetic layers 14 to fully build the inductor structure, i.e., the number of magnetic layers needed to provide a cumulative thickness greater than 1 micron to as many as several microns. As noted above, the number of magnetic layers within the grouping is not intended to be limited and will generally depend on the magnitude of tensile stress for the particular magnetic material. In the deposition of the alternating insulating layers 12 and magnetic layers 14, the insulating layer 12 is first deposited directly on the processed wafer 16.

Generally, the number of alternating insulating layers 12 and magnetic layers 14 initially deposited onto the processed wafer 16 represents at least about 10% of the fully built inductor structure. In one or more embodiments, the number of alternating insulating layers 12 and magnetic layers 14 first deposited onto the processed wafer 16 represents at least about 25% of the fully built inductor structure. In still other embodiments, the number of alternating insulating layers 12 and magnetic layers 14 first deposited onto the processed wafer 16 represents at least about 50% of the fully built inductor structure. Reference to fully built inductor structure is intended to refer to the total number of magnetic and insulating layers within the inductor structure.

Figure 4:
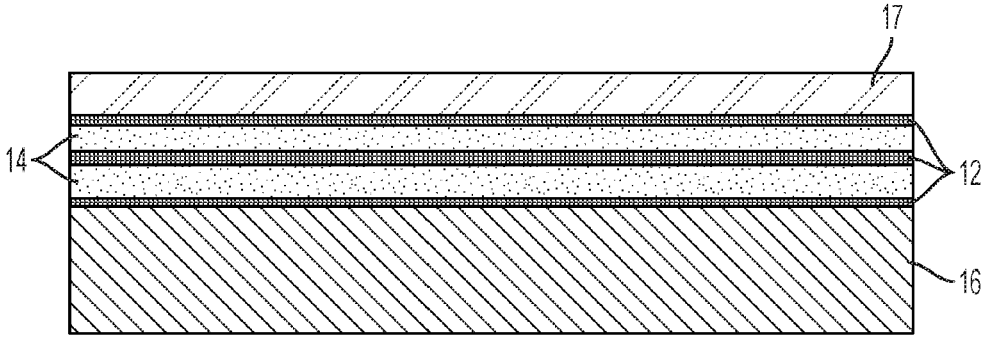
FIG. 4 depicts a schematic cross-sectional view of the inductor structure following deposition of a first hard mask layer onto the alternating insulating layers and magnetic layers.

Referring now to FIG. 4, once the desired number of alternating insulating layers 12 and magnetic layers 14 are initially deposited onto the processed wafer 16, a hard mask layer 17 is deposited onto insulating layer 12. The hard mask layer can include an insulating material, for example, silicon nitride (SiN), SiOCN, or SiBCN. The hard mask layer can be deposited using a deposition process, including, but not limited to, PVD, CVD, PECVD, or any combination thereof.

Figure 5:
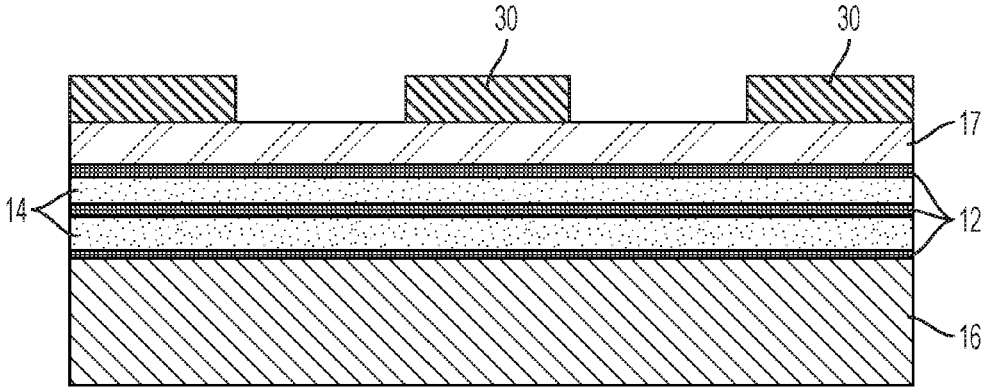
FIG. 5 depicts a schematic cross-sectional view of the inductor structure following photoresist deposition on the first hard mask layer and subsequent patterning of the photoresist.

In FIG. 5, conventional photolithography and an anisotropic etch process (e.g., reactive ion etch) are used to define a resist pattern 30. The photolithography process can comprise, for example, introducing electromagnetic radiation such as ultraviolet light through an overlay mask to cure a photoresist material (not shown). Depending upon whether the resist is positive or negative, uncured portions of the resist are removed to form the resist pattern including openings (spacings) to expose portions of the underlying alternating insulating layers 12 and magnetic layers 14. The openings generally range from 300 to 500 Angstroms, although smaller or larger openings can be utilized.

The material defining photoresist layer can be any appropriate type of photo-resist materials, which can partly depend upon the device patterns to be formed and the exposure method used. For example, material of photo-resist layer can include a single exposure photoresist suitable for, for example, argon fluoride (ArF); a double exposure resist suitable for, for example, thermal cure system; and/or an extreme ultraviolet (EUV) resist suitable for, for example, an optical process. Photoresist layer can be formed to have a thickness ranging from about 30 nm to about 150 nm in various embodiments. The resist pattern can be formed by applying any appropriate photo-exposure method in consideration of the type of photo-resist material being used.

Figure 6:
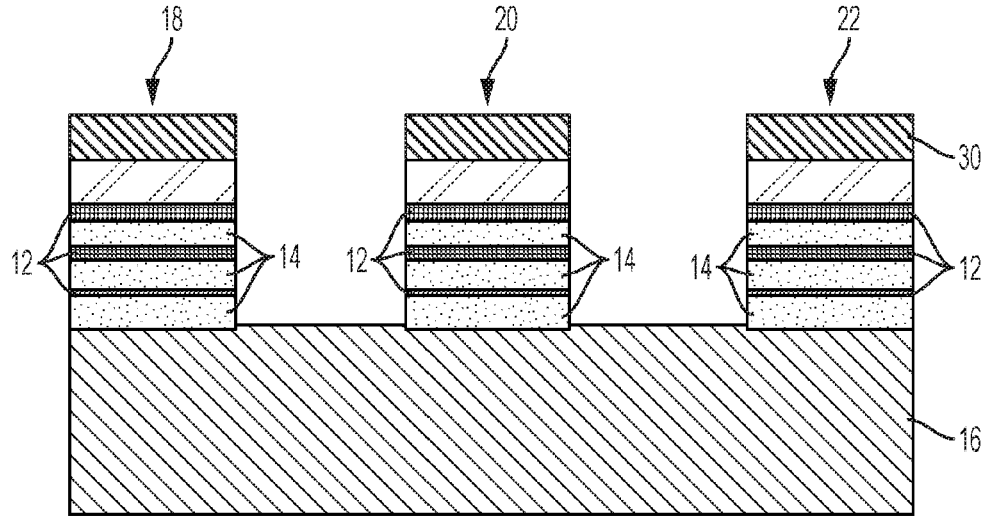
FIG. 6 depicts a schematic cross-sectional view of the inductor structure following anisotropic etching to define film stacks.

In FIG. 6, the resist pattern 30 is anisotropically etched to define film stacks 18, 20, 22. The anisotropic etch can be a wet etch or a dry etch process. An exemplary etching process is ion beam etching.

Figure 7:
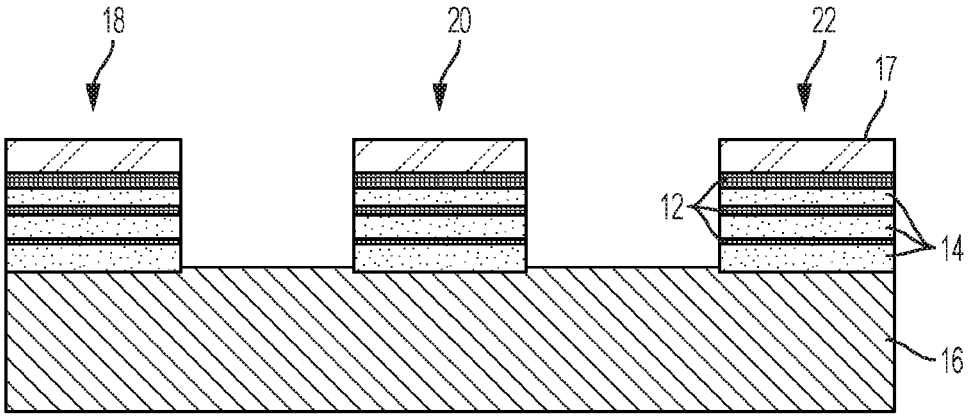
FIG. 7 depicts a schematic cross-sectional view of the inductor structure following deposition removal of the photoresist.

In FIG. 7, the photoresist layer 30 is removed using the hard mask as an etch stop. The photoresist layer can be removed by wet etching or drying etching. The remaining structure includes the various film stacks 18, 20, 22, which includes alternating insulating layers 12 and magnetic layers 14 as well as hard mask 17.

Figure 8:
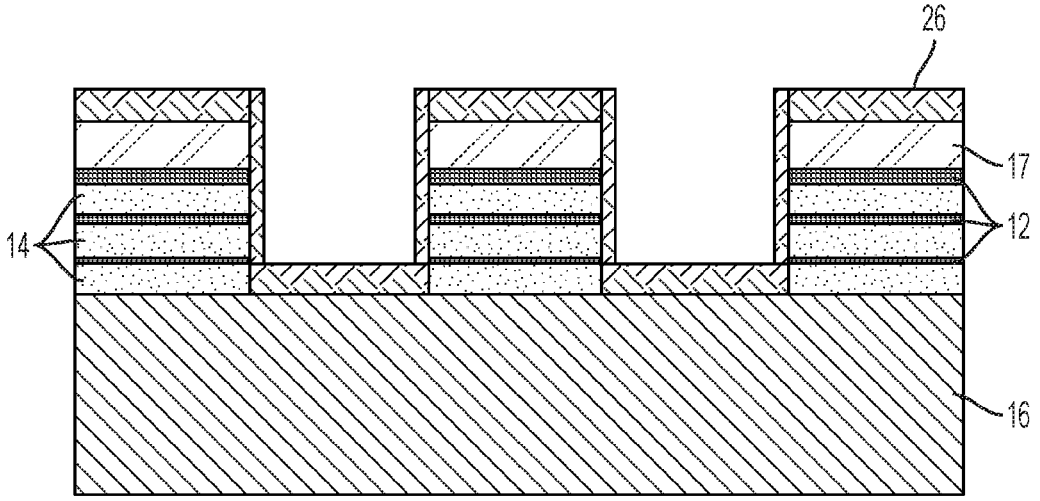
FIG. 8 depicts a schematic cross-sectional view of the inductor structure following deposition of a conformal layer of a dielectric isolation layer onto the film stacks.

In FIG. 8, a dielectric isolation layer 26 is then conformally deposited. The dielectric isolation layer has a thickness effective to elastically isolate the underlying magnetic layers within the film stacks 18, 20, and 22 from the other film stacks. In one or more embodiments, the thickness of the dielectric isolation layer ranges from 100 nm to 2000 nm. In one or more embodiments, the thickness can vary from 100 nm to 1000 nm; and in still other embodiments, the thickness can range from 200 to 800 nm. Suitable dielectric materials include, but are not limited to, silicon dioxide, silicon nitride or the like. The conformal dielectric layer can be deposited by CVD, PVD, PECVD or the like. By way of example, the conformal dielectric can be deposited by atomic layer deposition at a thickness of about 500 nm.

Figure 9:
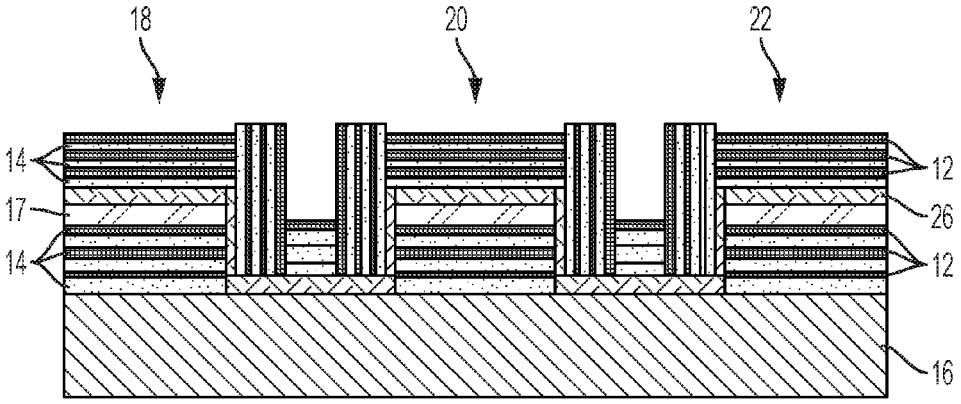
FIG. 9 depicts a schematic cross-sectional view of the inductor structure following deposition of a portion of the alternating insulating layers and magnetic layers in the inductor structure.

In FIG. 9, at least one additional grouping of alternating insulating layers 12 and magnetic layers 14 is conformally deposited onto the dielectric layer 26. Again, the number of alternating insulating layers 12 and magnetic layers 14 is a fraction of the number of alternating insulating layers 12 and magnetic layers 14 to fully build the inductor structure, i.e., the number of magnetic layers needed to provide a cumulative thickness greater than 1 micron to as many as several microns.

Figure 10:
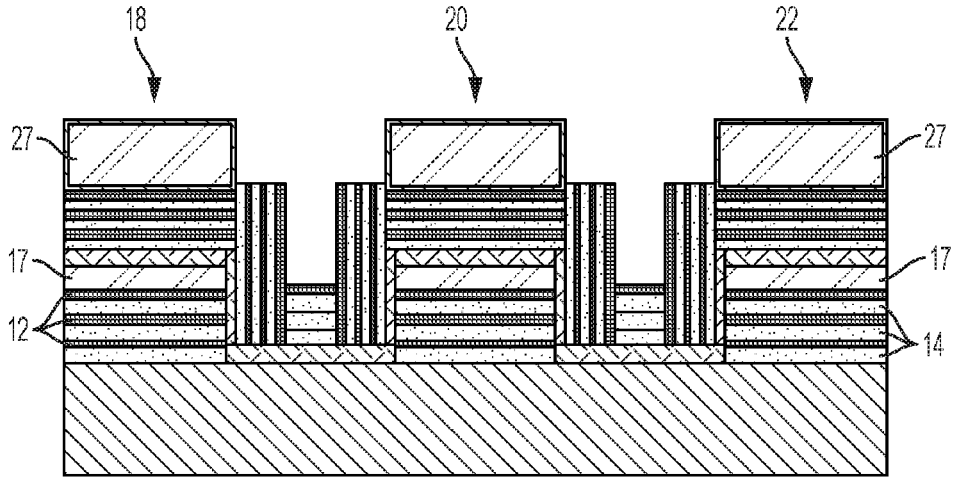
FIG. 10 depicts a schematic cross-sectional view of the inductor structure following deposition of a hard mask onto the film stacks.

In FIG. 10, a hard mask is then selectively deposited onto the films stacks 18, 20, 22.

Figure 11:
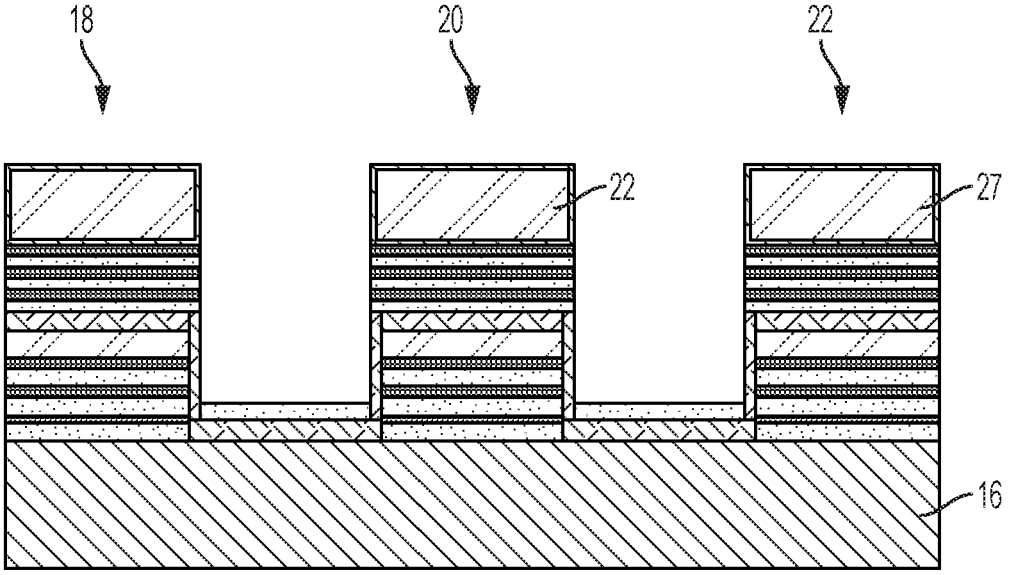
FIG. 11 depicts a schematic cross-sectional view of the inductor structure following deposition of an additional hard mask layer onto the alternating insulating layers and magnetic layers of FIG. 10.

In FIG. 11, the alternating magnetic layers and insulating layer within the space are removed; thereby leaving multiple film stacks 18, 20, and 22.

The process can be repeated until the desired magnetic layer thickness is reached. The repeated processing can include deposition of additional dielectric isolation layers to insure the film stacks are electrically isolated from one another. Advantageously, the spaced apart film stacks relieve the tensile stress of the magnetic materials in an amount effective to prevent wafer bowing.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form described. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated It should be apparent that there can be many variations to this diagram or the steps (or operations) described herein without departing from the spirit of the invention. For instance, the steps can be performed in a differing order or steps can be added, deleted or modified. All of these variations are considered a part of the claimed invention.

While the preferred embodiment to the invention had been described, it will be understood that those skilled in the art, both now and in the future, can make various improvements and enhancements which fall within the scope of the claims which follow. These claims should be construed to maintain the proper protection for the invention first described.

What is claimed is:

1. An inductor structure comprising:

a plurality of laminated film stacks adjacent to one another and separated by a space, each film stack comprising alternating layers of magnetic materials and insulating materials disposed on a processed wafer and having a thickness less than 500 nanometers;

a first conformal dielectric isolation layer on a plurality of first film stacks including on a bottom surface of the space, on sidewalls of adjacent ones of the first film stacks and on a top surface of each one of the plurality of first film stacks, the dielectric isolation layer having a thickness effective to electrically isolate each of the first film stacks from one another; and at least one additional grouping of lithographically patterned laminated film stacks on the first conformal dielectric isolation layer and overlying each one of the plurality of first film stacks so as to define the plurality of laminated film stacks adjacent to one another and separated by the space, the at least one additional grouping of the lithographically patterned laminated film stacks comprising alternating layers of magnetic materials and insulating materials having a thickness less than 500 nanometers;

at least one additional conformal dielectric isolation layer on the at least one additional grouping of the lithographically patterned laminated film stacks, and wherein the layers of magnetic materials have a cumulative thickness greater than 1 micron.

2. The inductor structure of claim 1, wherein the laminated film stacks are separated by the space is at a distance of 300 to 500 Angstroms.

3. The inductor structure of claim 1, wherein the magnetic material is selected from the group consisting of CoFe, CoFeB, CoZrTi, CoZrTa, CoZr, CoZrNb, CoZrMo, CoTi, CoNb, CoHf, CoW, FeCoN, FeCoAlN, CoP, FeCoP, CoPW, CoBW, CoPBW, FeTaN, FeCoBSi, FeNi, CoFeHfO, CoFeSiO, CoZrO, CoFeAlO, and combinations thereof.

4. The inductor structure of claim 1, wherein the insulator materials are selected from the group consisting of silicon dioxide, silicon nitride, silicon oxynitride, and combinations thereof.

5. The inductor structure of claim 1, wherein the dielectric isolation layer comprises silicon dioxide, silicon nitride, silicon oxynitride, and combinations thereof.

6. The inductor structure of claim 1, wherein the dielectric isolation layer has a thickness of 100 nm to 1000 nm.

7. The inductor structure of claim 1, further comprising at least one hard mask on or within the film stacks.

8. The inductor structure of claim 1, wherein the inductor structure is a closed yoke inductor.

9. The inductor structure of claim 1, wherein the inductor structure is a solenoid inductor.

10. The inductor structure of claim 1, wherein each of the magnetic layers have a thickness of 50 nanometers to 100 nanometers and each of the insulator layers have a thickness of 10 nanometers to 50 nanometers.

11. The inductor structure of claim 1, wherein the insulator material layers have a thickness effective to electrically isolate each magnetic material layer from other magnetic material layers in the laminated film stack.

* * * * *